US007944706B2

(12) United States Patent
Fujino

(10) Patent No.: US 7,944,706 B2
(45) Date of Patent: May 17, 2011

(54) ELECTRICAL UNIT FOR BOAT AND OUTBOARD MOTOR

(75) Inventor: Kenichi Fujino, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 474 days.

(21) Appl. No.: 12/025,171

(22) Filed: Feb. 4, 2008

(65) Prior Publication Data

US 2008/0185182 A1 Aug. 7, 2008

(30) Foreign Application Priority Data

Feb. 5, 2007 (JP) ..... 2007-025255

(51) Int. Cl.
*H05K 7/00* (2006.01)

(52) U.S. Cl. ..... 361/760; 174/521

(58) Field of Classification Search ..... 361/761, 361/836, 679, 760; 320/7, 8; 174/520
See application file for complete search history.

(56) References Cited

U.S. PATENT DOCUMENTS

| | | | | |
|---|---|---|---|---|
| 4,081,738 | A * | 3/1978 | Roller | 320/117 |
| 4,755,785 | A * | 7/1988 | Bernstein | 337/186 |
| 6,374,765 | B1 * | 4/2002 | Marotta | 114/293 |
| 6,903,736 | B1 * | 6/2005 | Stefan | 345/419 |
| 2006/0018098 | A1 * | 1/2006 | Hill et al. | 361/708 |
| 2006/0054335 | A1 * | 3/2006 | Rapp et al. | 174/48 |
| 2007/0171315 | A1 * | 7/2007 | Aoyama | 348/836 |

FOREIGN PATENT DOCUMENTS

| | | | |
|---|---|---|---|
| JP | 2918887 B2 | | 7/1999 |
| WO | WO2006045770 | * | 5/2006 |

* cited by examiner

*Primary Examiner* — Jinhee J. Lee
*Assistant Examiner* — Yuriy Semenenko
(74) *Attorney, Agent, or Firm* — Keating & Bennett, LLP

(57) ABSTRACT

An electrical unit includes one of a large current relay, a circuit protection fuse, and an operation time display section fixed on a circuit board having an external connector. The electrical unit is incorporated in a case having an opening, and the electrical unit is sealed by a sealing resin which fills the case. An operation time display section sealed in the case extends from the sealing resin at the opening of the case.

10 Claims, 3 Drawing Sheets

ELECTRICAL UNIT FOR BOAT AND OUTBOARD MOTOR

BACKGROUND OF THE INVENTION

1. Field of the Invention

The present invention relates to an electrical unit for a boat such as an engine control module for controlling engine operations and an outboard motor including the electrical unit.

2. Description of the Related Art

Conventional outboard motors have a configuration such that relays, fuses, branch-circuit components, an engine control module (hereinafter referred to as ECM), an operation time display section for measuring the engine operation time and so forth are positioned separately using wiring members such as a wire harness. Also, an operation time measuring device of a boat propulsion unit is known as disclosed in FIG. 8 in JP-B-2918887, in which an operation time displaying device (hour meter) is attached to mounting holes provided on the front wall of a CDI (Capacitor Discharge Ignition) so that it is visible from the front side (outside).

However, the invention described in JP-B-2918887 has problems and demands as described in the following three items below.

First, a relay, a fuse, and a branch-circuit component have the following problems on a conventional outboard motor.

The relay which drives a large current is separately disposed from an ECM, the branch-circuit component which branches a current or a signal is connected to a wire harness, and the circuit protection fuse is fixedly mounted to the wire harness. Therefore, this increases costs including the cost for the mounted components, operation costs, and the working hours required to mount the components.

Since the relay, the fuse, the branch-circuit component, an engine control module and so forth are provided at separate locations, a large space is required for mounting these components. Accordingly, an outboard motor, for example, becomes large and troublesome to transport or carry.

The wire harness connected to the branch-circuit component which divides a current or a signal must have waterproofing at its branch connecting point. However, insufficient waterproofing, fatigue from long use, or the like cause an electrical defect or a mechanical defect if contacted by water.

When a fuse circuit is incorporated as a separate component in an engine, a fuse connecting portion may be broken by vibration of the engine. In order to solve this problem, measures have been taken for reducing vibrations at a large cost. The cost is not small and tends to increase.

Second, on the other hand, an operation time display section has the following problems.

There are high costs for the mounting work and the components in order to make a construction to display an operation time of the engine by calculating from the number of revolutions of a generator or the like. This is because additional wiring in the outboard motor and additional components for mounting are needed. These extra costs make it difficult to lower the total cost to a user.

Furthermore, incorrect information is sometimes provided for a boat operator because the operation time display section is constructed to calculate the operation time by counting a pulse signal generated by the rotation of the generator which may pick up noise from the connection wiring and cause a malfunction.

Third, in the operation time display section, there are many cases in which simple mounting holes, simplified attaching to the mounting holes, reduced working hours, or reduced working costs are insufficiently achieved. Therefore, a solution to these problems is required.

SUMMARY OF THE INVENTION

In order to overcome the problems described above, preferred embodiments of the present invention provide a new electrical unit for a boat which makes it possible: (a) to reduce the number of wire harnesses and accessory components; (b) to downsize these components or eliminate them; (c) to enhance accuracy; (d) to facilitate handling; and (e) to reduce necessary costs and meet requirements by incorporating a large current relay, a circuit protection fuse, and an operation time display section in a case for an electrical unit such as an ECM for a boat and eliminating having to drill the mounting holes. A further preferred embodiment provides an outboard motor including such a novel electrical unit.

A preferred embodiment of the present invention preferably includes at least one of the electrical components among a large current drive relay, a circuit protection fuse, and an operation time display section fixed on a circuit board having an external connector incorporated in a housing section. The housing section has an opening and a sealing resin which fills the housing section, wherein at least one of the electrical components sealed in the housing section extends from the surface of the sealing resin at the opening of the housing section.

The electrical component may be at least one of a circuit protection fuse and an operation time display section.

The operation time display section is preferably an LCD or LED module which is visible from the surface of the sealing resin.

The operation time display section preferably displays an operation time of an engine.

According to another preferred embodiment, a display surface is preferably exposed such that a surrounding member surrounds the display surface to tightly block out the sealing resin.

The circuit protection fuse is preferably covered by a fuse cover and the circuit protection fuse is exposed when the fuse cover is removed.

According to another preferred embodiment of the present invention, the sealing resin is preferably a polyurethane resin.

Another preferred embodiment of the present invention provides a boat including an electrical unit as described above.

The at least one electrical component preferably defined by a large current drive relay, a circuit protection fuse, and an operation time display section fixed on a circuit board having an external connector is incorporated in a housing section having an opening and preferably sealed by a sealing resin which fills the housing section. Therefore, all or at least one of electrical components among a large current drive relay, a circuit protection fuse, and an operation time display section eliminate separate assembly, thereby reducing costs for the mounted components and operation costs and achieving savings in time and labor. The above-described advantages are achieved by preferably providing a circuit pattern on the circuit board for mounting the large current relay, the circuit protection fuse, and the operation time display section. Elimination of an external assembly for the electrical components such as a large current relay, a circuit protection fuse, and an operation time display section thus can reduce wiring in an outboard motor, allow efficient use of the space in the outboard motor, and reduce the size of the outboard motor, for example, thereby achieving easier handling (e.g., transportation, carrying or the like).

Further, not only down-sizing the wire harness for a branch circuit but also eliminating a branch circuit and its components from the wire harness can be achieved, thereby simplifying the circuit. Therefore, a cost reduction in manufacturing and improved protection from exposure to water can be achieved.

Furthermore, since at least one of the electrical components sealed in the housing section preferably protrudes from the sealing resin at the opening of the housing section, it is not necessary to provide mounting holes on a wall for exposing the electrical component. Therefore, in addition to achieving easier manufacturing, drilling of the mounting holes can be eliminated at the same time. Accordingly, simplified operations and savings in labor can be facilitated.

Therefore, preferred embodiments of the present invention solve all the problems as described above in (a) to (e).

Since the electrical component may be at least one of a circuit protection fuse and an operation time display section, further advantages described below are obtained. That is, the present preferred embodiment provides the following advantages. If the electrical component is the circuit protection fuse, the circuit protection fuse can be easily replaced from the outside. On the other hand, if the electrical component is the operation time display section, since it displays or outputs the operation time of the engine to a user or a maintenance person, it can notify the user of required maintenance such as changing the oil and the operation time at a low cost. Further, when driving elements and components that are subject to periodic maintenance fail before the periodic maintenance, the time of failure will be determined from the operation time, thereby achieving savings in time and labor during repair.

The operation time display section is preferably a liquid crystal display (LCD) or a light emitting diode (LED) module which is visible from the outside, which makes it possible to provide a small-size and light-weight product having high visibility and a long life resistant to shocks and vibrations.

A display surface of the operation time display section is preferably exposed in such a manner that a surrounding member surrounds the display surface to block out the sealing resin, which makes it possible to easily provide a product with a display surface which is open and easily visible. Further, the surrounding member advantageously functions as a decorating frame and a waterproofing frame as well as a framework by which the sealing resin is blocked in.

The circuit protection fuse is preferably covered by a fuse cover and the circuit protection fuse is exposed when the fuse cover is removed. Therefore, the circuit protection fuse can be prevented from being exposed to water and can easily be exchanged.

Since the sealing resin is preferably a polyurethane resin having elasticity and the capability of absorbing vibrations, breaking of a fuse connecting portion and the like can be avoided.

Since preferred embodiments of the present invention include an electrical unit for a boat according as described above, a compact outboard motor having the advantages of the electrical unit as set forth above can be easily obtained at a low cost.

Other features, elements, characteristics and advantages of the present invention will become more apparent from the following detailed description of preferred embodiments of the present invention (with reference to the attached drawings).

DETAILED DESCRIPTION OF THE PREFERRED EMBODIMENTS

Hereinafter, an ECM 10 as an example of an electrical unit for a boat and an outboard motor 11 including the ECM 10 will be described as a preferred embodiment of the present invention with reference to FIGS. 1 to 4.

Figure 1:
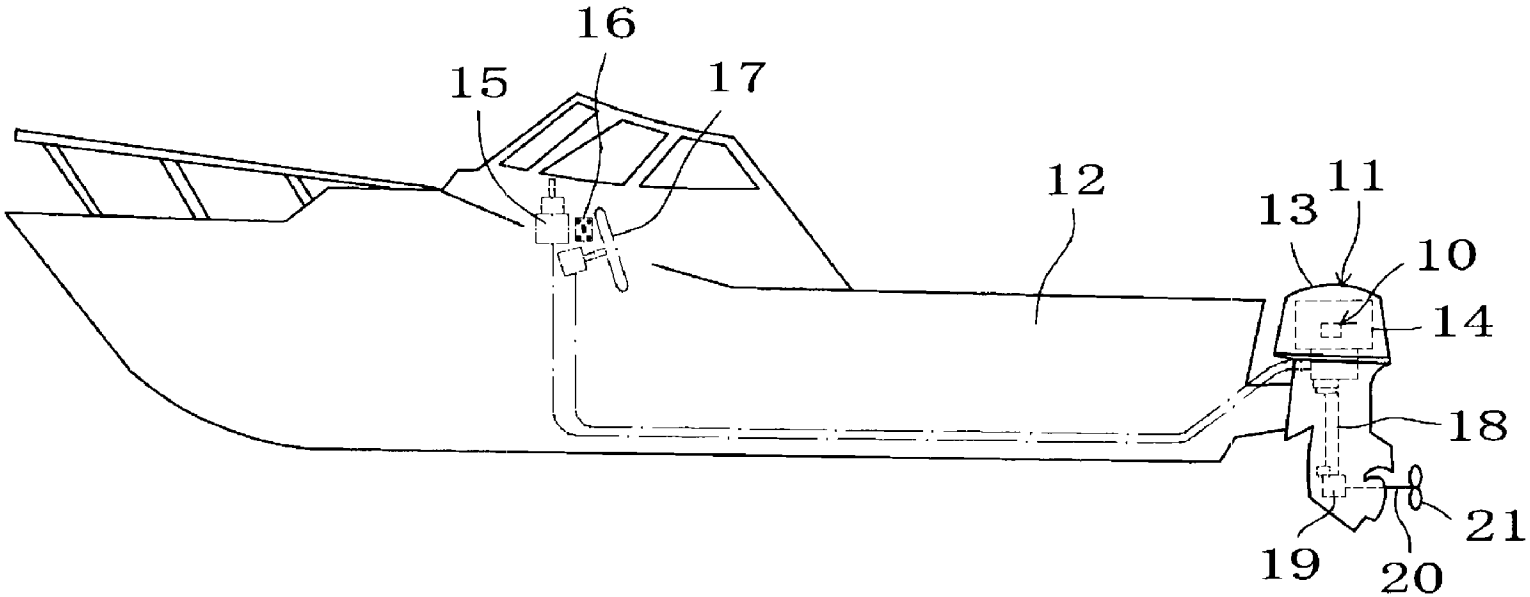
FIG. 1 is a side view illustrating an outboard motor including an ECM according to a preferred embodiment of the present invention.

In FIG. 1, reference numeral 11 denotes an outboard motor provided at the stern of a hull 12.

As shown in FIG. 1, the outboard motor 11 is constructed such that an engine 14 is provided with a cowling 13 which covers the top thereof and the ECM 10 is disposed at a side of the engine 14.

When the engine 14 is in operation by controlling a remote control device 15, a key switch unit 16, and a steering wheel unit 17 provided at an operator's seat of the hull 12, the operation causes the outboard motor 11 to rotate a propeller 21 via a drive shaft 18, a shifting device 19, and a propeller shaft 20, thereby propelling the hull 12.

Figure 2:
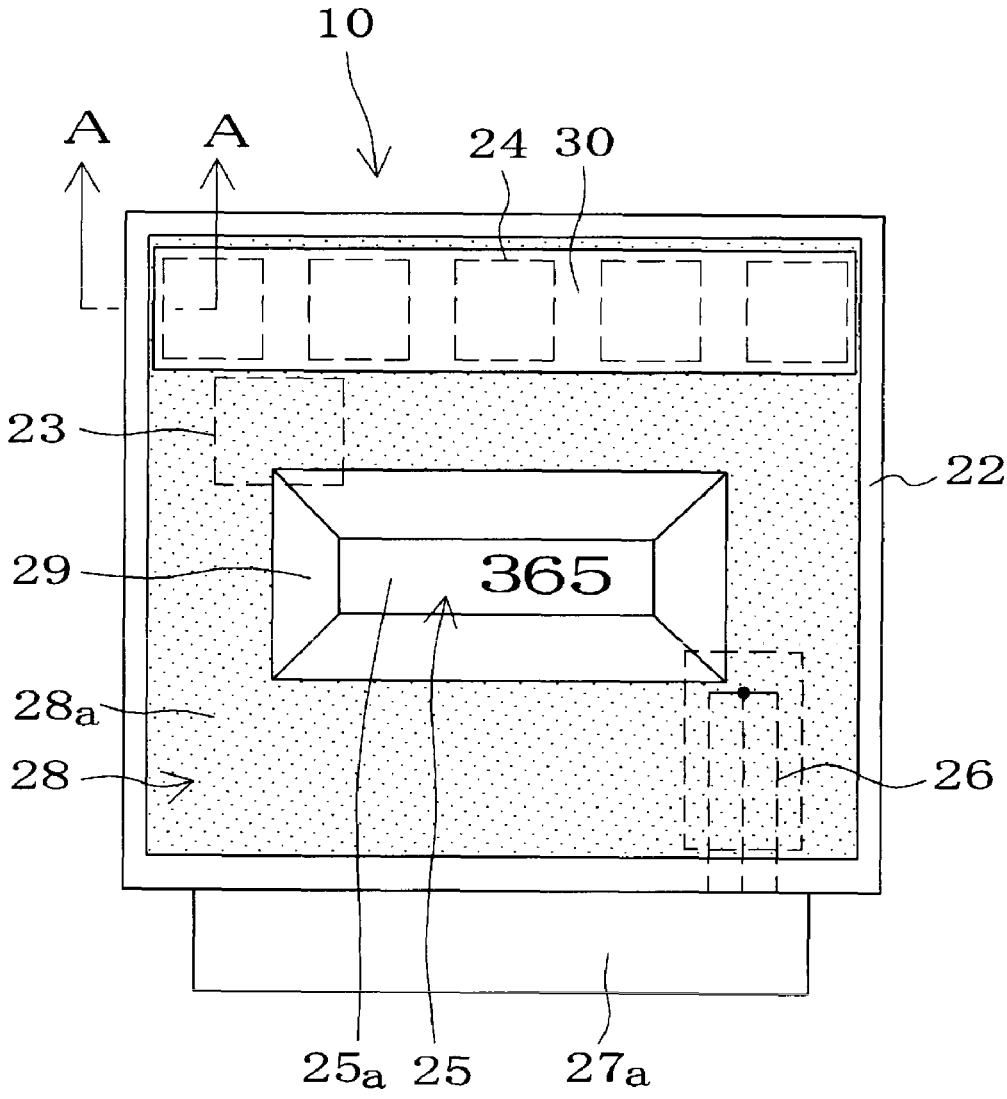
FIG. 2 is a front view of the ECM according to the preferred embodiment shown in FIG. 1.
Figure 3:
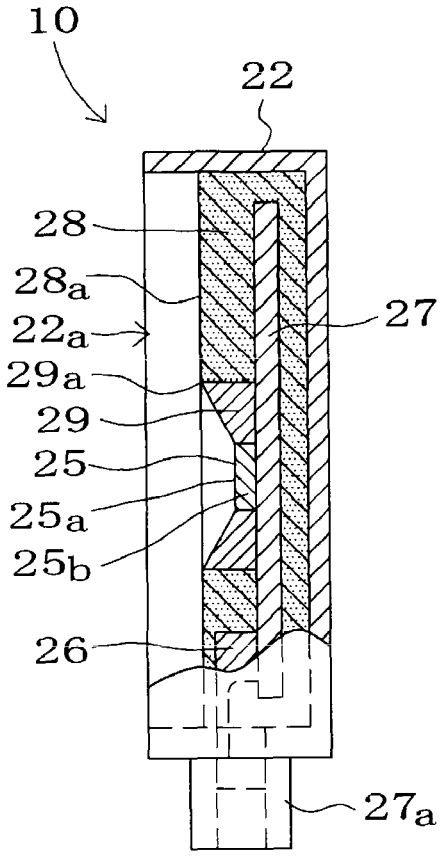
FIG. 3 is a partial cross-sectional side view of the ECM according to the preferred embodiment shown in FIG. 1.
Figure 4:
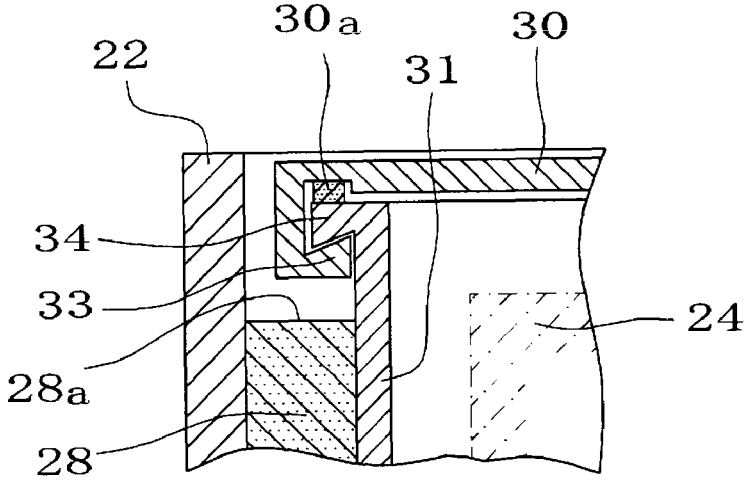
FIG. 4 is an enlarged cross-sectional view of the ECM taken along line A-A in FIG. 2.

On the other hand, as shown in FIGS. 2 to 4, the ECM 10 is preferably housed within a case 22 as a housing section to be described below, and includes components which enable the following functions to be performed.

The ECM 10 performs calculation/determination by a control computer, a control program, and control data based on a signal which represents an operation state detected by pressure and temperature sensors and an operation requirement signal by the user such as a throttle operation. Then the ECM 10 outputs control signals of the fuel injection amount and the ignition timing respectively to a fuel injection valve and an ignition coil, and outputs various indication signals, alarm signals and so on according to the calculation/determination.

Incidentally, the construction of the ECM which provides the above-described functions may preferably be generally the same as a conventional ECM. Accordingly, detailed description and illustration of these functions is omitted since it is not essential for the practice of the preferred embodiments of the present invention.

The case 22 is preferably made of a hard resin, for example, and preferably has a substantially square opening which is open in one direction or to the front. The case 22 also has an attachment section (not shown) to allow the case 22 to be attached to the engine 14.

The case 22 houses various electrical components, e.g., a large current drive relay 23, a circuit protection fuse 24, an operation time display section 25, and a branch-circuit component 26 in such a manner as described below.

The large current drive relay 23, the protection fuse 24 provided with multiple elements, the operation time display section 25, and the branch-circuit component 26 are preferably mounted on a circuit board 27 integrally provided with an external connector 27*a*. These components are housed in the case 22 into which a sealing resin 28, or any other suitable material, is filled in such a manner that the circuit protection fuse 24 and the operation time display section 25 are exposed at an opening 22*a* in the front side of the case 22 with their surfaces preferably aligned with a surface 28*a* of the sealing resin 28.

In this regard, the circuit board 27 preferably includes a circuit pattern for mounting the large current drive relay 23, a circuit pattern for mounting the circuit protection fuse 24, a circuit pattern for mounting the branch-circuit component 26 for dividing a power supply line and a signal line, and a circuit pattern for mounting the operation time display section 25. Easy mounting of the large current drive relay 23, the circuit protection fuse 24, the operation time display section 25, and the branch-circuit component 26 on the circuit board 27 can be achieved by this construction. Furthermore, providing the circuit patterns allows wire harnesses and accessory components to be eliminated or reduced, thereby reducing costs for mounted components and operation costs and achieving savings in time and labor.

Further, filling the case 22 with the resin 28, which preferably becomes rigid, eliminates separate assembly which has been conventionally performed and reduces wiring in the outboard motor, thereby allowing efficient use of the space in the outboard motor. Accordingly, reduced size of the outboard motor and easy handling (transportation, carrying or the like) thereof can easily be achieved.

Additionally, the wire harness of the branch circuit can be eliminated or down-sized, and also the branch circuit and its components from the wire harness can be eliminated. Therefore, improved protection from exposure to water as well as simplification of the circuit and cost reduction in manufacturing can be achieved.

Furthermore, since the circuit protection fuse 24 and the operation time display section 25 are exposed at an opening 22*a* in the front side of the case 22 with their surfaces aligned with a surface 28*a* of the sealing resin 28, it is not necessary to provide mounting holes in a wall of the case 22 for exposing the circuit protection fuse 24 and the operation time display section 25. Therefore, in addition to ease of manufacturing, the drilling of mounting holes can also be eliminated. Accordingly, simplified operation and savings in labor can be further facilitated.

An elastic resin is preferred as the sealing resin 28 for purposes of efficiency. Polyurethane resin is a preferred resin. Since polyurethane resin has elasticity and the capability of absorbing vibrations, it prevents the large current drive relay 23, the circuit protection fuse 24, the operation time display section 25, and the branch-circuit component 26 from external vibrations and shocks. Accordingly, breaking a fuse connecting portion as described above can be avoided. The sealing resin 28 also contributes to waterproofing/oilproofing, thereby protecting the large current drive relay 23, the circuit protection fuse 24, the operation time display section 25, and the branch-circuit component 26 from water and oil.

While the large current drive relay 23 is preferably embedded, a display surface 25*a* of the operation time display section 25 is exposed since the operation time display section 25 is required to be visible from the outside. An LCD module 25*b* is preferably used in the operation time display section 25, however, an LED module or a blinking light pattern may be used. Further, the operation time display section 25 may display an operating time of the engine 14 counted by an engine controller stored in its memory. The operating time may be displayed by sequentially lighting up the digits from the first to the last digit or from the last digit to the first digit.

Since the LCD module 25*b* of the operation time display section 25 displays or outputs the operation time of the engine 14 to a user or a maintenance person, this can provide notice to the user for required maintenance such as changing the oil and the operation time of the engine 14 at a low cost. Further, when driving parts subject to periodic maintenance fail before the periodic maintenance, the failure point will be noted from the operation time, thereby achieving savings in time and labor during repair.

The display surface 25*a* is exposed in such a manner that a surrounding member 29 preferably made of hard synthetic resin surrounds the display surface 25*a* to block out the sealing resin 28 and allow the sealing resin 28 to be filled and cured. In this regard, as shown in FIG. 3, the height of the surface 28*a* of the sealing resin 28 is preferably made the same as that of a top 29*a* of the surrounding member 29. However, the height of the top 29*a* of the surrounding member 29 may be intentionally made higher, or the surrounding member 29 may be removed after the sealing resin 28 has been cured. As a result, the display surface 25*a* is exposed and easily viewed. In this regard, since the sealing resin 28 does not flow onto the display surface 25*a* of the operation time display section 25, the amount of the sealing resin 28 becomes small, thereby achieving a reduction of the amount of the sealing resin 28 and a weight reduction of the ECM.

As shown in FIG. 4, the circuit protection fuse 24 is preferably arranged in a set case 31 with a water-proof cap 30 so that it may be easily replaced. The set case 31 is preferably fixed to the circuit board 27 at its bottom and its opening preferably protrudes above the surface 28*a* of the sealing resin 28. The protruding opening is covered by the waterproof cap 30 in a detachable manner and waterproofed by a packing 30*a*. The water-proof cap 30 is preferably constructed by a depressed periphery 33 and a projecting periphery 34 engaging each other. As shown in FIG. 2, the circuit protection fuse 24 is preferably made of multiple elements. However, the circuit protection fuse 24 may be made of a single element. Further, a detachable construction such as a socket type fuse may be employed to provide easy replacement of the circuit protection fuse 24.

As described above, the circuit protection fuse 24 may be replaced from the front side. However, it should be appreciated that the circuit protection fuse 24 may be replaced from the lateral side, the upper side, the lower side, or the back side by opening/closing a blank cap.

While preferred embodiments of the present invention have been described above, it is to be understood that variations and modifications will be apparent to those skilled in the art without departing the scope and spirit of the invention. The scope of the invention, therefore, is to be determined solely by the following claims.

What is claimed is:

1. An electrical unit for a boat comprising:

a housing section including an opening;

at least one electrical component defined by at least one of a circuit protection fuse and an operation time display section arranged on a circuit board having an external connector, the at least one electrical component arranged within the housing section; and a sealing material filling the housing section, a top surface of the sealing material defining a top surface of the electrical unit such that the top surface of the sealing material is not covered by the housing section, the sealing material embedding the circuit board and at least a portion of the at least one electrical component therein; wherein the at least one electrical component in the housing section is exposed through the top surface of the sealing material at the opening of the housing section such that at least a portion of the at least one electrical component is not covered by the sealing material.

2. The electrical unit for a boat according to claim 1, further comprising a current drive relay embedded in the sealing material.

3. The electrical unit for a boat according to claim 1, wherein the at least one electrical component is the operation time display section including an LCD or LED module which is visible from the top surface of the sealing material.

4. The electrical unit for a boat according to claim 1, wherein the at least one electrical component is the operation time display section which displays an operation time of an engine.

5. The electrical unit for a boat according to claim 4, wherein a display surface of the operation time display section is exposed through the top surface of the sealing material, and the display surface has a member surrounding the display surface to block out the sealing material.

6. The electrical unit for a boat according to claim 1, wherein the at least one electrical component is the circuit protection fuse covered by a fuse cover, and the circuit protection fuse is exposed when the fuse cover is removed.

7. The electrical unit for a boat according to claim 1, wherein the sealing material is polyurethane resin.

8. The electrical unit for a boat according to claim 1, wherein the sealing material is rigid.

9. An outboard motor comprising:

a motor; and the electrical unit according to claim 1.

10. The electrical unit for a boat according to claim 5, wherein the display surface of the operation time display section is arranged below the top surface of the sealing material.

* * * * *